US010116107B2

(12) United States Patent
Tada et al.

(10) Patent No.: US 10,116,107 B2
(45) Date of Patent: Oct. 30, 2018

(54) CONNECTOR PRODUCTION METHOD AND CONNECTOR

(71) Applicant: Japan Aviation Electronics Industry, Limited, Tokyo (JP)

(72) Inventors: Takashi Tada, Tokyo (JP); Katsumi Arai, Tokyo (JP); Toshiyuki Shimoda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/620,296

(22) Filed: Jun. 12, 2017

(65) Prior Publication Data

US 2017/0279235 A1 Sep. 28, 2017

Related U.S. Application Data

(63) Continuation of application No. PCT/JP2016/050317, filed on Jan. 7, 2016.

(30) Foreign Application Priority Data

Jan. 29, 2015 (JP) ..... 2015-015728

(51) Int. Cl.
*H01R 13/648* (2006.01)
*H01R 24/60* (2011.01)
(Continued)

(52) U.S. Cl.
CPC ..... *H01R 24/60* (2013.01); *H01R 13/5202* (2013.01); *H01R 13/6581* (2013.01); *H01R 43/20* (2013.01); *H01R 2107/00* (2013.01)

(58) Field of Classification Search
CPC .... H01R 24/60; H01R 2107/00; H01R 43/20; H01R 13/5202; H01R 13/6585; H01R 13/6581; H01R 12/24
(Continued)

(56) References Cited

U.S. PATENT DOCUMENTS 9,350,121 B2 * 5/2016 Ju ..... H01R 13/6585
2015/0229077 A1 * 8/2015 Little ..... H01R 12/724 439/78

(Continued)

FOREIGN PATENT DOCUMENTS

CN 203859322 U 10/2014
CN 203859324 U 10/2018

(Continued)

*Primary Examiner* — Jean F Duverne
(74) *Attorney, Agent, or Firm* — Muncy, Geissler, Olds & Lowe, P.C.

(57) ABSTRACT

A connector production method includes the steps of holding a flat plate conductor with a first insulator, joining central portions of one or more contacts to the first insulator such that front end portions of the one or more contacts are exposed at a front part of the first insulator and rear end portions of the one or more contacts project from a rear part of the first insulator, placing a shell made of metal over the first insulator such that the shell covers outer peripheral portions of the one or more contacts, fixing and electrically connecting the shell to the flat plate conductor, and forming a second insulator such that the second insulator covers the rear part of the first insulator and a rear part of the shell while the rear end portions of the one or more contacts project from the second insulator.

17 Claims, 7 Drawing Sheets

(51) Int. Cl.

| | |
|---|---|
| ***H01R 13/6581*** | (2011.01) |
| ***H01R 13/52*** | (2006.01) |
| ***H01R 43/20*** | (2006.01) |
| *H01R 107/00* | (2006.01) |

(58) Field of Classification Search
USPC ..... 439/607.11
See application file for complete search history.

(56) References Cited

U.S. PATENT DOCUMENTS

| | | | |
|---|---|---|---|
| 2015/0311636 | A1 | 10/2015 | Chang et al. |
| 2015/0311645 | A1 | 10/2015 | Chang |
| 2017/0271820 | A1 | 9/2017 | Ho |

FOREIGN PATENT DOCUMENTS

| | | | |
|---|---|---|---|
| EP | 2790274 | A1 | 10/2014 |
| EP | 3220488 | A1 | 9/2017 |
| JP | 5623836 | B | 11/2014 |
| TW | M453270 | U | 5/2013 |
| TW | M456614 | U1 | 7/2013 |
| TW | M484832 | U | 8/2014 |
| WO | WO 2014/103591 | A1 | 7/2014 |
| WO | WO 2014/203486 | | 4/2016 |

* cited by examiner

CONNECTOR PRODUCTION METHOD AND CONNECTOR

BACKGROUND OF THE INVENTION

The present invention relates to a connector production method, particularly to a connector production method for producing a connector having one or more contacts and a shell.

In addition, the present invention relates to a connector having one or more contacts and a shell.

Recently, electronic devices such as computers and mobile phones have been widely spread, and these electronic devices are normally equipped with connectors to be connected with outside devices to transmit electrical signals. As a connector of this type, desired is one which is shielded from the electromagnetic interference by means of a metal shell covering an outer periphery of an insulator that holds contacts such that the transmitted electrical signals are prevented from being affected by electromagnetic waves from outside and that a peripheral electronic device is prevented from being affected by electromagnetic noise generated from the transmitted electrical signals.

For example, JP 5623836 B discloses a connector production method in which, when a shell 1 and a plurality of contacts 2 are fixed with an insulator, the insulator is formed through resin molding while a shell carrier 4 that holds the shell 1 via shell-connecting pieces 3 and a contact carrier 6 that holds the contacts 2 via contact-connecting pieces 5 are connected to each other and are maintained in this state, as illustrated in FIG. 18. Since the shell carrier 4 and the contact carrier 6 are connected to each other, the insulator can be formed with end portions of the contacts 2 being positioned at predetermined locations within the shell 1.

However, if the shell 1 and the shell carrier 4 connected to each other via the shell-connecting pieces 3 have positional variability therebetween due to production tolerance, and similarly if the plurality of contacts 2 and the contact carrier 6 connected to each other via the contact-connecting pieces 5 have positional variability therebetween due to production tolerance, even when the shell carrier 4 is connected to the contact carrier 6, the shell 1 and the end portions of the contacts 2 disposed within the shell 1 may be misaligned with each other and may undergo the resin molding with such misalignment.

For a connector having a shell, attempts have been made to construct a connector in which a flat plate conductor such as a ground plate, a mid-plate and the like is held by an insulator and disposed inside the shell adjacent to contacts so that the shell and the flat plate conductor are brought to the ground level to enhance the shielding effect.

A connector having such structure requires a large number of components and has difficulty in integrally molding all components at a time through molding of a resin that constitutes the insulator. A bonding step using an adhesive may be added as a countermeasure, but the use of an adhesive raises the production cost, which would be a problem.

SUMMARY OF THE INVENTION

The present invention has been made to eliminate the conventional drawback as above, aiming at providing a connector production method capable of producing a highly-accurate connector having a large number of components in which misalignment among the components is suppressed without the use of an adhesive.

In addition, the present invention also aims at providing a highly-accurate connector having a large number of components in which misalignment among the components is suppressed.

A connector production method according to the present invention comprises:

holding a flat plate conductor with a first insulator; joining central portions of one or more contacts to the first insulator such that front end portions of the one or more contacts are exposed at a front part of the first insulator and rear end portions of the one or more contacts project from a rear part of the first insulator; placing a shell made of metal over the first insulator such that the shell covers outer peripheral portions of the one or more contacts; fixing and electrically connecting the shell to the flat plate conductor; and forming a second insulator such that the second insulator covers the rear part of the first insulator and a rear part of the shell while the rear end portions of the one or more contacts project from the second insulator.

A connector according to the present invention comprises: a first insulator; a flat plate conductor that is held by the first insulator; one or more contacts whose central portions are joined to the first insulator such that front end portions of the one or more contacts are exposed at a front part of the first insulator and rear end portions of the one or more contacts project from a rear part of the first insulator; a shell made of metal that is placed over the first insulator so as to cover outer peripheral portions of the one or more contacts and that is fixed to and electrically connected to the flat plate conductor, and a second insulator that is formed so as to cover the rear part of the first insulator and a rear part of the shell while the rear end portions of the one or more contacts project from the second insulator.

DETAILED DESCRIPTION OF THE INVENTION

Embodiments of the present invention are described below based on the appended drawings.

Embodiment 1

Figure 1:
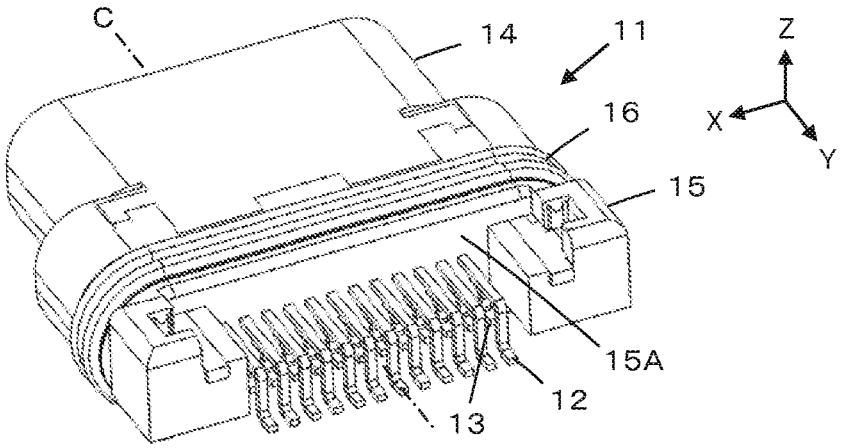
FIG. 1 is a perspective view showing a connector according to Embodiment 1 of the present invention.

FIG. 1 illustrates a connector 11 according to Embodiment 1. The connector 11 is a receptacle connector to be fixed to a substrate in an electronic device such as a mobile device or an information device and connected to a counter connector (not shown) that is inserted along a fitting axis C.

The connector 11 includes a plurality of first contacts 12 each extending in a direction of the fitting axis C which are arranged in a direction orthogonal to the fitting axis C and a plurality of second contacts 13 each extending in the direction of the fitting axis C and arranged in parallel to the plurality of first contacts 12.

A tubular shell 14 made of metal and extending along the fitting axis C is disposed so as to cover the outer peripheries of front end portions in the fitting axis C direction of the first contacts 12 and second contacts 13, and a second insulator 15 is formed so as to close a rear end portion in the fitting axis C direction of the shell 14.

A seamless waterproof member 16 made of an elastic material such as rubber is disposed so as to surround the outer periphery of the second insulator 15.

For convenience, a direction from front to back of the connector 11 along the fitting axis C is called "Y direction", an arrangement direction of the first contacts 12 and second contacts 13 "X direction", and a direction perpendicular to an XY plane and extending from the second contacts 13 to the first contacts 12 "Z direction".

Figure 2:
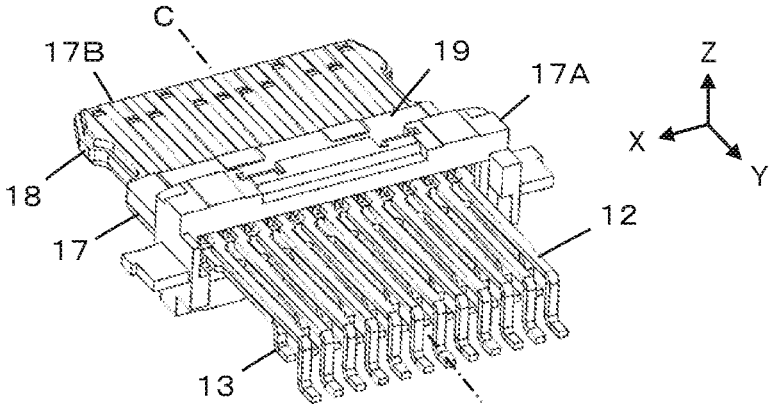
FIG. 2 is a perspective view showing a first insulator and contacts used in the connector according to Embodiment 1.

A first insulator 17 illustrated in FIG. 2 is placed inside the shell 14, and central portions in the Y direction of the first contacts 12 and central portions in the Y direction of the second contacts 13 are held by the first insulator 17, respectively. The first insulator 17 includes an insulator body 17A and a tongue-like section 17B extending from the insulator body 17A in the −Y direction along the fitting axis C, while end portions in the −Y direction of the first contacts 12 are exposed from the tongue-like section 17B toward the +Z direction, and end portions in the −Y direction of the second contacts 13 are exposed from the tongue-like section 17B toward the −Z direction. End portions in the +Y direction of the first contacts 12 and second contacts 13 are exposed at the rear part of the insulator body 17A and, as illustrated in FIG. 1, project rearward, i.e., in the +Y direction from a rear face 15A of the second insulator 15.

A mid-plate 18 made of metal is embedded in the first insulator 17 and disposed between the first contacts 12 and the second contacts 13, and a pair of ground plates 19 made of metal are fixed to the first insulator 17 and cover, respectively from the +Z direction side and the −Z direction side, the central portions in the Y direction of the first contacts 12 and the central portions in the Y direction of the second contacts 13, respectively. The mid-plate 18 and the pair of ground plates 19 are electrically connected to the shell 14 with the first insulator 17 being accommodated inside the shell 14.

The mid-plate 18 and the pair of ground plates 19 constitute a flat plate conductor in the present invention. When the shell 14, the mid-plate 18 and the pair of ground plates 19 that are electrically connected to one another are brought to ground potential, the connector is shielded from electromagnetic waves, whereby reliable signal transmission can be performed while suppressing influences of the electromagnetic waves.

Figure 3:
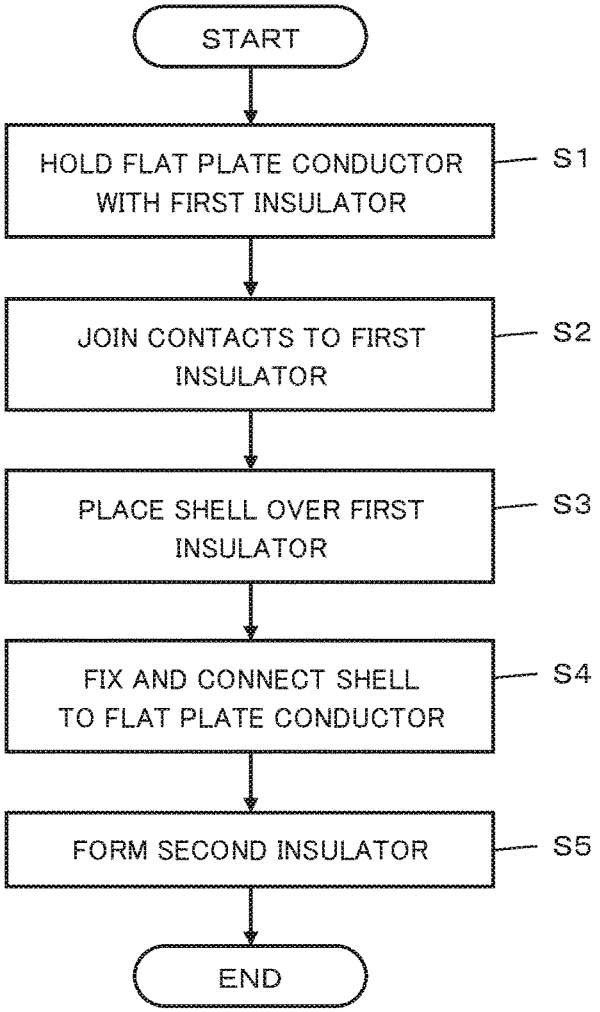
FIG. 3 is a flowchart illustrating a connector production method.

Referring to a flowchart in FIG. 3, a connector production method to obtain the connector 11 will be described.

In Step S1, the mid-plate 18 and the pair of ground plates 19 as the flat plate conductor are held by the first insulator 17.

Figure 4:
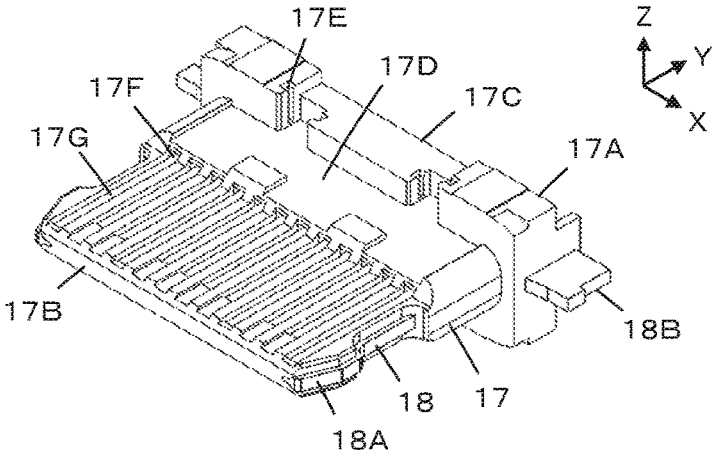
FIG. 4 is a perspective view showing the first insulator that holds a mid-plate.

First, the first insulator 17 is formed using an insulating resin through insert-molding, whereby the mid-plate 18 is embedded in the first insulator 17 as illustrated in FIG. 4. At this time, opposite side portions in the X direction at an end in the −Y direction of the mid-plate 18 are respectively exposed from opposite side ends in the X direction of the tongue-like section 17B and constitute counter connector-connecting sections 18A to be connected to a counter connector when the connector 11 is fitted with the counter connector, whereas opposite side portions in the X direction at an end in the +Y direction of the mid-plate 18 each overhang from the insulator body 17A in the X direction as overhanging sections 18B.

On the surface of the first insulator 17 facing the +Z direction, the insulator body 17A has a stepped section 17C located at an end in the +Y direction and projecting in the +Z direction and a flat ground plate-mounting surface 17D located on the −Y direction side next to the stepped section 17C. The stepped section 17C is provided with a plurality of ground plate-fixing grooves 17E extending in the Z direction for fixing one of the ground plates 19. Furthermore, the insulator body 17A is provided with a plurality of through-holes 17F corresponding to the plurality of first contacts 12 and extending in the Y direction, while the tongue-like section 17B is provided with a plurality of contact grooves 17G respectively connected to the plurality of through-holes 17F of the insulator body 17A and extending in the Y direction.

Although not shown, also on the surface of the first insulator 17 facing the −Z direction, the insulator body 17A similarly has a stepped section 17C located at an end in the +Y direction and projecting in the −Z direction and a flat ground plate-mounting surface 17D located on the −Y direction side next to the stepped section 17C. The stepped section 17C is provided with a plurality of ground plate-fixing grooves 17E extending in the Z direction for fixing the other ground plate 19. Furthermore, the insulator body 17A is provided with a plurality of through-holes 17F corresponding to the plurality of second contacts 13 and extending in the Y direction, while the tongue-like section 17B is provided with the plurality of contact grooves 17G respectively connected to a plurality of through-holes 17F of the insulator body 17A and extending in the Y direction.

Figure 5:
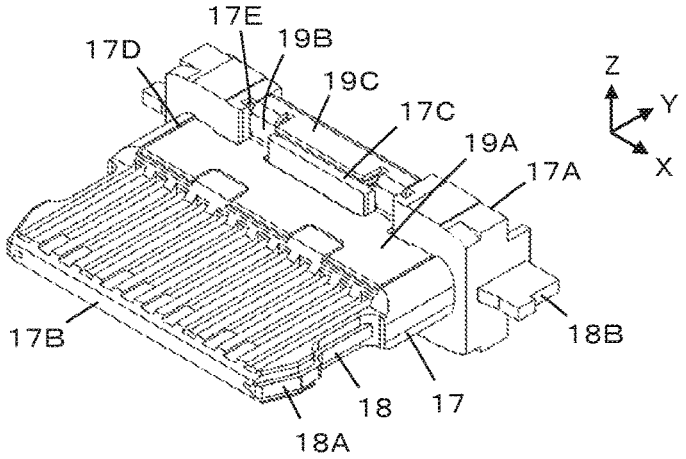
FIG. 5 is a perspective view showing the first insulator that holds ground plates.

Next, as illustrated in FIG. 5, on the surface of the first insulator 17 facing the +Z direction, one of the ground plates 19 is mounted on the insulator body 17A. The ground plate 19 includes a flat section 19A extending along the XY plane, a pair of upright sections 19B each extending in the +Z direction from an end portion in the +Y direction of the flat section 19A, and a shell connection section 19C connecting between ends in the +Z direction of the two upright sections 19B and extending along the XY plane.

The ground plate 19 is aligned with the insulator body 17A such that the flat section 19A of the ground plate 19 is located above the ground plate-mounting surface 17D of the insulator body 17A and the shell connection section 19C is located above the stepped section 17C of the insulator body 17A, and the pair of upright sections 19B of the ground plate 19 are pressed into the corresponding ground plate-fixing grooves 17E of the insulator body 17A, whereby the ground plate 19 can be held by the first insulator 17.

On the surface of the first insulator 17 facing the −Z direction, the other ground plate 19 is mounted on the insulator body 17A in the same manner.

After the mid-plate 18 and the pair of ground plates 19 as the flat plate conductor are held by the first insulator 17 in this manner, the first contacts 12 and the second contacts 13 are joined to the first insulator 17 in Step S2.

Figure 6:
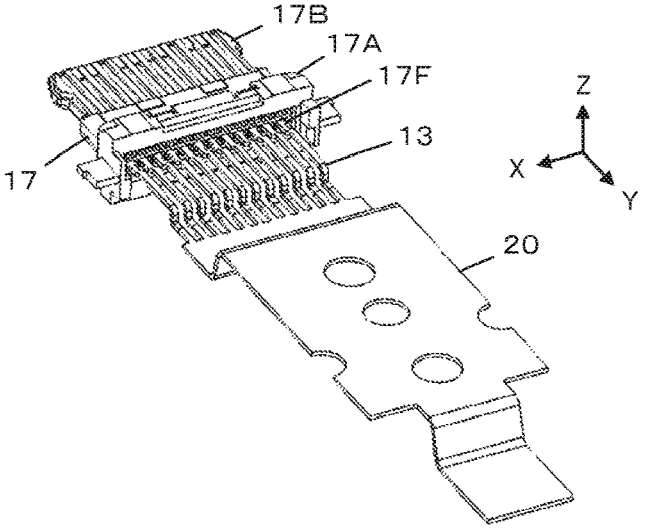
FIG. 6 is a perspective view showing a plurality of second contacts as being attached to a second contact carrier and pressed into the first insulator.

As illustrated in FIG. 6, first, the second contacts 13 attached to a second-contact carrier 20 are pressed into the through-holes 17F formed on the −Z direction side of the first insulator 17. While the second-contact carrier 20 is attached to the ends in the +Y direction of the second contacts 13, the ends in the −Y direction of the second contacts 13 are aligned with ends in the +Y direction of the through-holes 17F, and the second-contact carrier 20 is moved in the −Y direction relatively to the first insulator 17, whereby the second contacts 13 are pressed into the through-holes 17F from the +Y direction toward the −Y direction.

Figure 7:
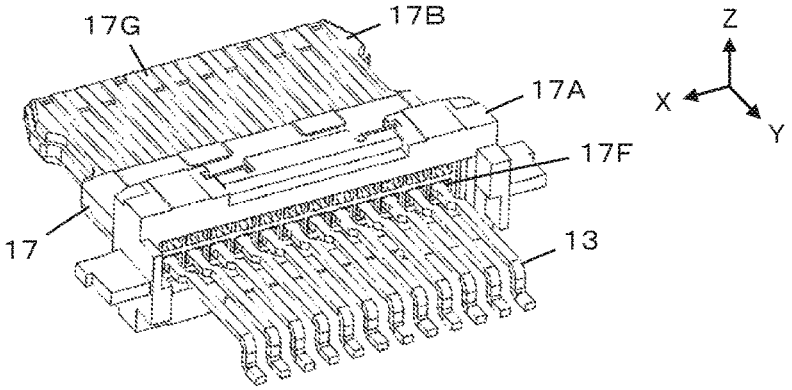
FIG. 7 is a perspective view showing the first insulator that holds the plurality of second contacts with the second contact carrier having been detached from the plurality of second contacts.

The second contacts 13 are pressed into the through-holes 17F until the ends in the −Y direction of the second contacts 13 project from the through-holes 17F to reach the tongue-like section 17B of the first insulator 17, central portions of the second contacts 13 are located inside the through-holes 17F and the ends in the +Y direction of the second contacts 13 are exposed in the +Y direction from the first insulator 17, and thereafter the second-contact carrier 20 is detached from the ends in the +Y direction of the second contacts 13. In this manner, the second contacts 13 are joined to and held by the first insulator 17 as illustrated in FIG. 7.

In this process, the ends in the −Y direction of the second contacts 13 projecting in the −Y direction from the through-holes 17F are inserted into the contact grooves 17G formed in the surface facing the −Z direction of the tongue-like section 17B of the first insulator 17.

Figure 8:
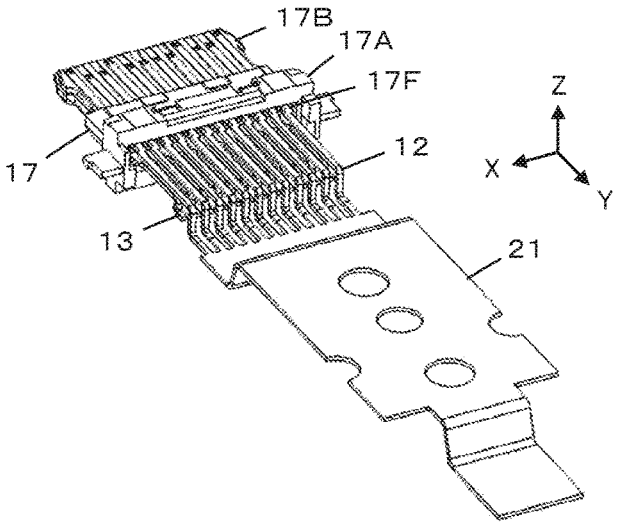
FIG. 8 is a perspective view showing a plurality of first contacts as being attached to a first contact carrier and pressed into the first insulator.

Once the second contacts 13 are joined to the first insulator 17, as illustrated in FIG. 8, the first contacts 12 attached to a first-contact carrier 21 are pressed into the through-holes 17F formed on the +Z direction side of the first insulator 17. The first-contact carrier 21 is attached to the ends in the +Y direction of the first contacts 12, the other ends in the −Y direction of the first contacts 12 are aligned with ends in the +Y direction of the through-holes 17F, and the first-contact carrier 21 is moved in the −Y direction relatively to the first insulator 17, whereby the first contacts 12 are pressed into the through-holes 17F from the +Y direction toward the −Y direction.

Figure 9:
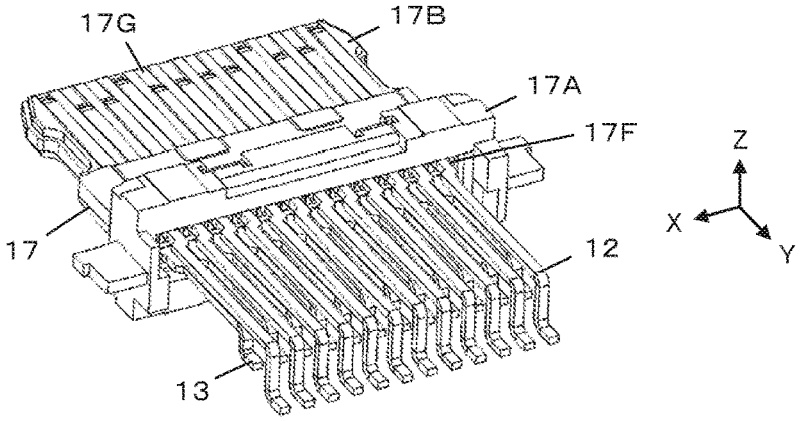
FIG. 9 is a perspective view showing the first insulator that holds the plurality of first contacts and the plurality of second contacts with the first contact carrier having been detached from the plurality of first contacts.

The first contacts 12 are pressed into the through-holes 17F until the ends in the −Y direction of the first contacts 12 project from the through-holes 17F to reach the tongue-like section 17B of the first insulator 17, central portions of the first contacts 12 are located inside the through-holes 17F and the ends in the +Y direction of the first contacts 12 are exposed in the +Y direction from the first insulator 17, and thereafter the first-contact carrier 21 is detached from the ends in the +Y direction of the first contacts 12. In this manner, the first contacts 12 are joined to and held by the first insulator 17 as illustrated in FIG. 9.

In this process, the ends in the −Y direction of the first contacts 12 projecting in the −Y direction from the through-holes 17F are inserted into the contact grooves 17G formed in the surface facing the +Z direction of the tongue-like section 17B of the first insulator 17.

Figure 10:
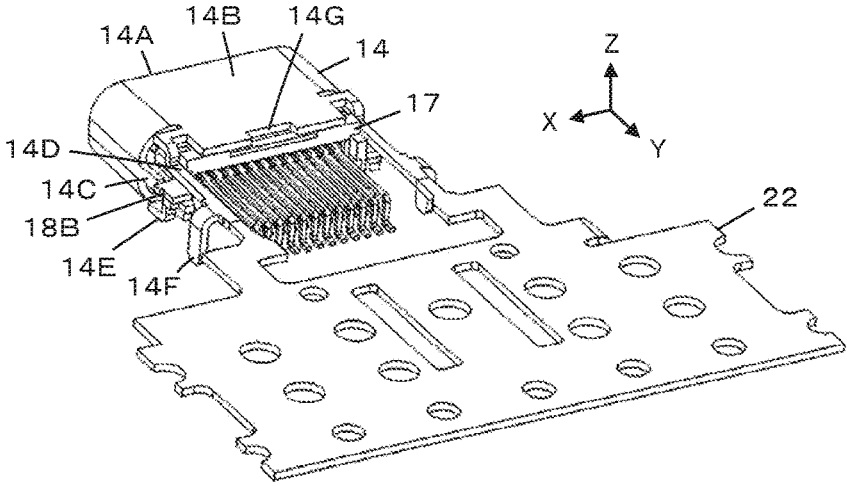
FIG. 10 is a perspective view showing a shell as being attached to a shell carrier and placed over the first insulator.

After the first contacts 12 and the second contacts 13 are joined to the first insulator 17 in this manner, the shell 14 is placed over the first insulator 17 in Step S3. As illustrated in FIG. 10, a shell carrier 22 is moved from the −Y direction toward the +Y direction relatively to the first insulator 17, whereby the shell 14 is placed over the first insulator 17 while being attached to the shell carrier 22.

The shell 14 includes a flattened tubular section 14A whose central axis extends along the Y direction and which has a larger length in the X direction than the length in the Z direction, and the tubular section 14A includes a pair of flat plate sections 14B extending along the XY plane and facing each other. At an end in the +Y direction of the tubular section 14A, provided are a pair of projection sections 14C projecting in the +Y direction respectively from opposite ends in the X direction of the tubular section 14A, a pair of arm sections 14D projecting in the +Y direction respectively from opposite ends in the X direction of the flat plate section 14B on the +Z direction side, and a pair of projection sections 14E projecting in the +Y direction respectively from opposite ends in the X direction of the flat plate section 14B on the −Z direction side.

The shell carrier 22 is attached to ends in the +Y direction of the pair of arm sections 14D. At an end in the +Y direction of each of the pair of arm sections 14D, a substrate connection section 14F projecting and extending in the −Z direction is provided. In addition, at an end in the +Y direction and in a central portion in the X direction of each flat plate section 14B, a cutout 14G is provided.

Figure 11:
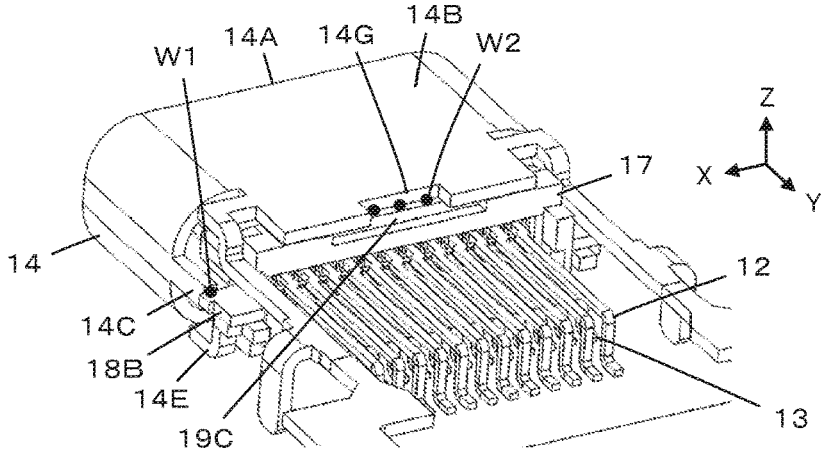
FIG. 11 is a partially enlarged perspective view showing the shell placed over the first insulator when viewed obliquely from above.

When tip-end surfaces of the pair of projection sections 14C projecting in the +Y direction from the tubular section 14A of the shell 14 respectively come into contact with end surfaces in the −Y direction of the corresponding overhanging sections 18B of the mid-plate 18 overhanging in the X direction from the first insulator 17 as illustrated in FIG. 11, the shell 14 is aligned with the first insulator 17.

At this time, tip ends of the pair of projection sections 14E projecting in the +Y direction from the flat plate section 14B on the −Z direction side of the tubular section 14A of the shell 14 respectively come into contact with surfaces facing the −Z direction of the corresponding overhanging sections 18B of the mid-plate 18.

The cutout 14G formed in the flat plate section 14B on the +Z direction side of the tubular section 14A of the shell 14 is positioned so as to be overlapped on the shell connection section 19C of the ground plate 19 that is disposed on the +Z direction side of the first insulator 17, whereby the shell connection section 19C is exposed inside the cutout 14G.

Figure 12:
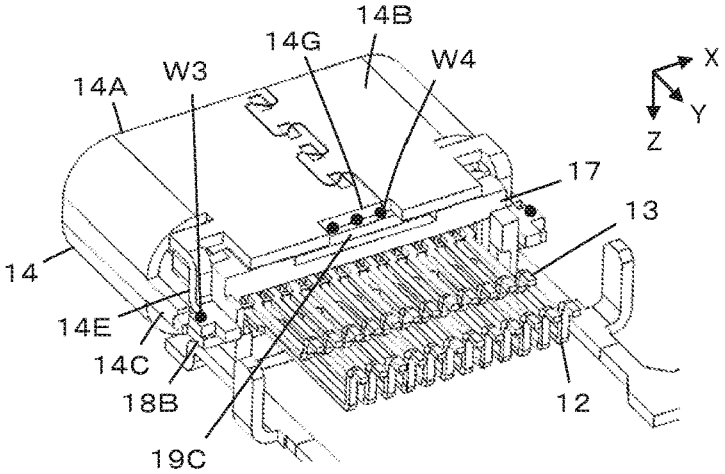
FIG. 12 is a partially enlarged perspective view showing the shell placed over the first insulator when viewed obliquely from below.

Similarly, as illustrated in FIG. 12, the cutout 14G formed in the flat plate section 14B on the −Z direction side of the tubular section 14A of the shell 14 is positioned so as to be overlapped on the shell connection section 19C of the ground plate 19 that is disposed on the −Z direction side of the first insulator 17, whereby the shell connection section 19C is exposed inside the cutout 14G.

After being placed over the first insulator 17 in this manner, the shell 14 is fixed to and electrically connected to the mid-plate 18 and the pair of ground plates 19 as the flat plate conductor in Step S4.

When the shell 14 is aligned with the first insulator 17, the tip-end surfaces of the pair of projection sections 14C of the shell 14 come into contact with the end surfaces in the −Y direction of the corresponding overhanging sections 18B of the mid-plate 18 as illustrated in FIG. 11. Accordingly, by means of welding between each of the projection sections 14C of the shell 14 and the corresponding overhanging section 18B of the mid-plate 18 to form a welded portion W1, the shell 14 can be fixed to and electrically connected to the mid-plate 18.

In addition, since the cutout 14G formed in the flat plate section 14B on the +Z direction side of the tubular section 14A of the shell 14 is positioned so as to be overlapped on the corresponding shell connection section 19C of the ground plate 19 disposed on the +Z direction side of the first insulator 17, by means of welding between an edge of the cutout 14G of the shell 14 and the shell connection section 19C of the ground plate 19 to form a weld W2, the shell 14 can be fixed to and electrically connected to the ground plate 19 disposed on the +Z direction side of the first insulator 17.

When the shell 14 is aligned with the first insulator 17, the tip ends of the pair of projection sections 14E of the shell 14 come into contact with the surfaces facing −Z direction of the corresponding overhanging sections 18B of the mid-plate 18 as illustrated in FIG. 12. Accordingly, by means of welding between each of the projection sections 14E of the shell 14 and the corresponding overhanging section 18B of the mid-plate 18 to form a welded portion W3, reliability of fixation and electrical connection between the shell 14 and the mid-plate 18 can be improved.

Furthermore, since the cutout 14G formed in the flat plate section 14B on the −Z direction side of the tubular section 14A of the shell 14 is positioned so as to be overlapped on the shell connection section 19C of the ground plate 19 disposed on the −Z direction side of the first insulator 17, by means of welding between an edge of the cutout 14G of the shell 14 and the shell connection section 19C of the ground plate 19 to form a welded portion W4, the shell 14 can be fixed to and electrically connected to the ground plate 19 disposed on the −Z direction side of the first insulator 17.

The welded portions W1 to W4 can be formed, for example, by laser welding using laser beam irradiation. More specifically, a contact portion between each of the projection sections 14C of the shell 14 and the corresponding overhanging section 18B of the mid-plate 18 is irradiated with a laser beam to form the welded portion W1; a boundary portion between the cutout 14G on the +Z direction side of the shell 14 and the shell connection section 19C of the ground plate 19 on the +Z direction side is irradiated with a laser beam to form the welded portion W2; the tip end of each projection section 14E of the shell 14 in contact with the −Z direction side of the corresponding overhanging section 18B of the mid-plate 18 is irradiated with a laser beam from the −Z direction to form the welded portion W3; and a boundary portion between the cutout 14G on the −Z direction side of the shell 14 and the shell connection section 19C of the ground plate 19 on the −Z direction side is irradiated with a laser beam to form the welded portion W4.

For the improved reliability of electrical connection between the shell 14 and the pair of ground plates 19 through welding, it is preferable to form a plurality of welded portions W2 in the cutout 14G on the +Z direction side of the shell 14 and a plurality of welded portions W4 in the cutout 14G on the −Z direction side of the shell 14. In FIGS. 11 and 12, welded portions W2 are formed at three locations within the cutout 14G on the +Z direction side of the shell 14, while welded portions W4 are formed at three locations within the cutout 14 on the −Z direction side of the shell 14.

After the shell 14 is fixed to and electrically connected to the mid-plate 18 and the pair of ground plates 19 as above, the second insulator 15 is formed in Step S5.

Figure 13:
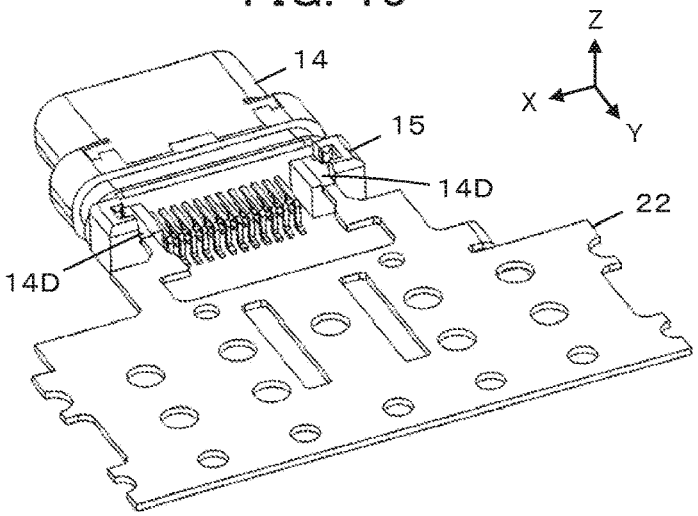
FIG. 13 is a perspective view showing a second insulator that is formed while the shell is attached to the shell carrier.

With the shell 14 being kept attached to the shell carrier 22 as illustrated in FIG. 13, a mold (not show) is fitted to the shell 14 and the first contacts 12 and the second contacts 13, and a molten insulating resin is poured into the mold and solidified, whereby the second insulator 15 is formed. Thereafter, the mold is removed, and the shell carrier 22 is detached from the ends in the +Y direction of the pair of arm sections 14D of the shell 14.

Figure 14:
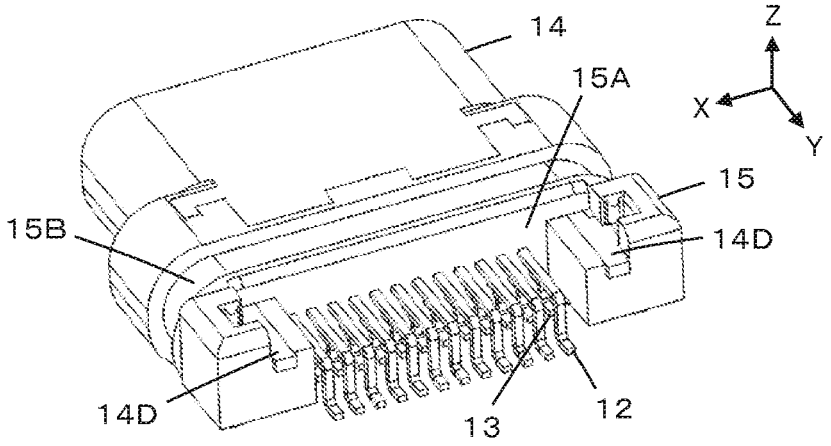
FIG. 14 is a perspective view showing the second insulator that holds the shell with the shell carrier having been detached from the shell.

Accordingly, as illustrated in FIG. 14, the rear part in the +Y direction of the shell 14 and the rear part in the +Y direction of the first insulator 17 covered by the shell 14 are closed by the second insulator 15, while the end portions in the +Y direction of the first contacts 12 and second contacts 13 project in the +Y direction from the rear face 15A of the second insulator 15.

The welded portions W1 to W4 between the mid-plate 18 or the pair of ground plates 19 and the shell 14 are covered by the second insulator 15.

In addition, a seamless waterproof member insertion groove 15B is formed so as to surround an outer periphery of the second insulator 15, and the waterproof member 16 is disposed in the waterproof-member insertion groove 15B, whereby the connector 11 shown in FIG. 1 is produced.

Since the second insulator 15 is thus formed, the insulating resin that constitutes the second insulator 15 adheres to surfaces of intermediate portions of the first contacts 12 and second contacts 13 covered by the second insulator 15, and, accordingly, even if water enters from front end portions in the −Y direction of the first contacts 12 and second contacts 13 exposed inside the shell 14 along the surfaces of the contacts, water is blocked at the adhesion site in the second insulator 15 and is prevented from reaching the rear face 15A side of the second insulator 15.

Similarly, since the second insulator 15 is thus formed, the insulating resin that constitutes the second insulator 15 also adheres to surfaces of the pair of arm sections 14D of the shell 14, and, accordingly, even if water enters from the tubular section 14A along the surface of the shell 14, water is blocked at the adhesion site between the second insulator 15 and the arm sections 14D of the shell 14 and is prevented from reaching the arm sections 14D that are exposed on the rear face 15A side of the second insulator 15.

Moreover, the seamless waterproof member 16 surrounding the outer periphery of the second insulator 15 is disposed.

Therefore, the connector 11 having waterproof properties can be realized.

As described above, since the second insulator 15 is formed after the welded portions W1 to W4 are formed to fix and electrically connect the shell 14 to the mid-plate 18 and the pair of ground plates 19, the highly accurate connector 11 having a large number of components in which misalignment among the components is suppressed without the use of an adhesive can be produced.

Because no adhesive is used, the production cost can be decreased and, at the same time, the production process can be simplified.

In Embodiment 1 above, the first-contact carrier 21 is detached from the first contacts 12 that are pressed into the first insulator 17, and thereafter in Step S3, the shell 14 attached to the shell carrier 22 is placed over the first insulator 17, but the present invention is not limited to this, and the shell 14 attached to the shell carrier 22 may be placed over the first insulator 17 while the first-contact carrier 21 is connected to the first contacts 12. In that case, it is required to align the shell 14 with the first insulator 17 without connecting the first-contact carrier 21 and the shell carrier 22 to each other to form the welded portions W1 to W4.

Embodiment 2

Figure 15:
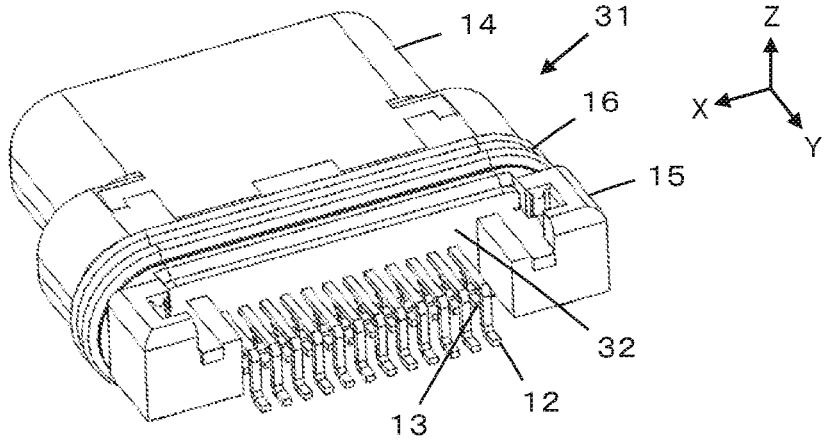
FIG. 15 is a perspective view showing a connector according to Embodiment 2.

FIG. 15 illustrates a connector 31 according to Embodiment 2.

The connector 31 is the same as the connector 11 of Embodiment 1 as illustrated in FIG. 1 with an addition of a waterproof sealing section 32 disposed on the rear face 15A of the second insulator 15 from which the end portions in the +Y direction of the first contacts 12 and second contacts 13 project.

The waterproof sealing section 32 can be formed by the process of coating, after the second insulator 15 is formed, a flowable sealing material made from a molten resin, adhesive or the like over the rear face 15A of the second insulator 15 so as to bury root portions of the first contacts 12 and second contacts 13 that project from the rear face 15A of the second insulator 15 and drying the sealing material. Alternatively, an elastic and waterproof material is preliminarily formed into a waterproof sealing member, and the waterproof sealing member is fitted onto the rear face 15A of the second insulator 15, whereby the waterproof sealing section 32 can be made.

Since the waterproof sealing section 32 is disposed on the rear face 15A of the second insulator 15 in this manner, even if water enters along surfaces of the first contacts 12 and second contacts 13 to reach the rear face 15A side of the second insulator 15, the waterproof sealing section 32 can block water and thus improve the waterproof properties.

Embodiment 3

Figure 16:
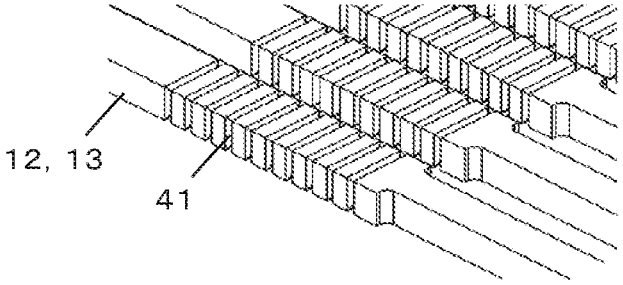
FIG. 16 is a partial perspective view showing contacts used in a connector according to Embodiment 3.

In the connector 11 of Embodiment 1 or the connector 31 of Embodiment 2 above, a contact-side waterproof shaped section 41 as illustrated in FIG. 16 may be provided to a surface of a portion of each of the first contacts 12 and second contacts 13 to be covered by the second insulator 15.

The contact-side waterproof shaped section 41 is to block entry of water along the surface of the first contact 12 or the second contact 13 and is composed of a plurality of grooves or a plurality of protrusions that are formed to surround and enclose the periphery of the first contact 12 or the second contact 13.

While the insulating resin that constitutes the second insulator 15 adheres to the surfaces of the portions of the first contacts 12 and second contacts 13 where the second insulator 15 covers as described above, since such contact-side waterproof shaped section 41 is provided to each of the first contacts 12 and second contacts 13, even if the insulating resin that had adhered to the surfaces of the first contacts 12 and second contacts 13 separates therefrom and allows water to enter along the surfaces thereof, water is blocked by the contact-side waterproof shaped sections 41 and cannot reach the rear face 15A side of the second insulator 15.

Accordingly, the connectors 11 and 31 can be configured to have further improved waterproof properties.

Figure 17:
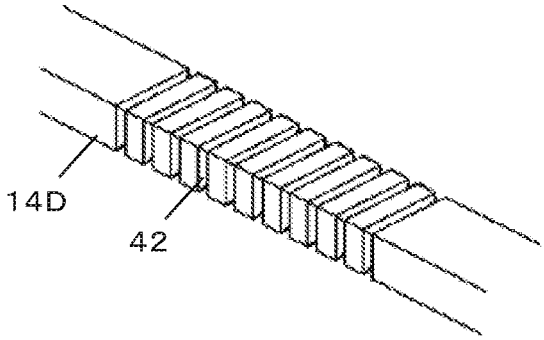
FIG. 17 is a partial perspective view showing an arm section of a shell used in the connector according to Embodiment 3.
Figure 18:
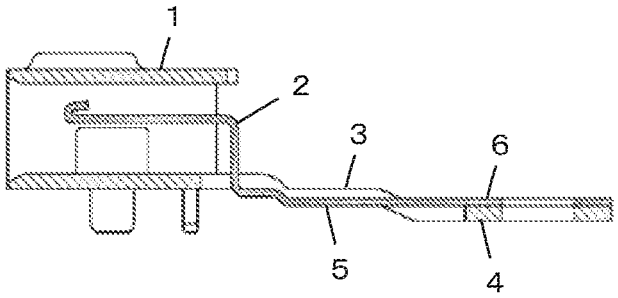
FIG. 18 PRIOR ART
FIG. 18 is a sectional side view illustrating a conventional connector production method.

Similarly, a shell-side waterproof shaped section 42 as illustrated in FIG. 17 may be provided on a surface of a portion of each of the pair of arm sections 14D of the shell 14 to be covered by the second insulator 15.

The shell-side waterproof shaped section 42 is to block entry of water along the surface of the arm section 14D of the shell 14 and is composed of a plurality of grooves or a plurality of protrusions that are formed to surround and enclose the periphery of the arm section 14D.

While the insulating resin that constitutes the second insulator 15 adheres to the surfaces of the portions of the arm sections 14D of the shell 14 where the second insulator 15 covers as described above, since such shell-side waterproof shaped section 42 as above is provided to each of the arm sections 14D, even if the insulating resin that had adhered to the surfaces of the arm sections 14D of the shell 14 separates therefrom and allows water to enter along the surfaces thereof, water is blocked by the shell-side waterproof shaped sections 42 and cannot reach portions of the arm sections 14D exposed from the rear face 15A of the second insulator 15.

Accordingly, the waterproof properties can be further improved.

While the contact-side waterproof shaped section 41 is composed of a plurality of grooves or a plurality of protrusions that are formed to surround and enclose the periphery of each of the first contacts 12 and the second contacts 13, and the shell-side waterproof shaped section 42 is composed of a plurality of grooves or a plurality of protrusions that are formed to surround and enclose the periphery of each of the arm sections 14D of the shell 14, the grooves or protrusions are not necessarily formed to surround and enclose the periphery, but may be formed partially along the circumference to exhibit the waterproof effect. Meanwhile, the better waterproof function can be achieved when the grooves or protrusions are formed to surround and enclose the periphery.

While each of the contact-side waterproof shaped section 41 and the shell-side waterproof shaped section 42 is composed of a plurality of grooves or protrusions, a single groove or protrusion can still suppress the entry of water along the interface between the relevant surface and the second insulator 15. In the meantime, the higher waterproof effect can be obtained when a plurality of grooves or protrusions are formed.

To suppress the entry of water along the interface between the relevant surface and the second insulator 15, it is preferable for a groove or protrusion to have a height difference of, for instance, not less than 0.01 mm.

While in the foregoing Embodiments 1 to 3, the first contacts 12 and the second contacts 13 are arranged in two rows separately on both surfaces of the mid-plate 18 to face each other, the present invention is not limited thereto and may be applied to a connector in which a plurality of contacts are arranged in a single row.

The number of contacts is not limited, and it suffices if one or more contacts are held in a housing.

What is claimed is:

1. A connector production method comprising:

holding a flat plate conductor with a first insulator;

joining central portions of one or more contacts to the first insulator such that front end portions of the one or more contacts are exposed at a front part of the first insulator and rear end portions of the one or more contacts project from a rear part of the first insulator;

placing a shell made of metal over the first insulator such that the shell covers outer peripheral portions of the one or more contacts;

fixing and electrically connecting the shell to the flat plate conductor; and forming a second insulator such that the second insulator closes the rear part of the first insulator and a rear part of the shell while the rear end portions of the one or more contacts project from the second insulator.

2. The connector production method according to claim 1, wherein the flat plate conductor includes ground plates that are disposed so as to be exposed on surfaces of the first insulator, and the ground plates are pressed into the first insulator to be held by the first insulator.

3. The connector production method according to claim 1, wherein the flat plate conductor includes a mid-plate that is disposed in a vicinity of front end portions of the one or more contacts, and the first insulator is formed so as to cover surfaces of the mid-plate so that the mid-plate is held by the first insulator.

4. The connector production method according to claim 1, wherein the shell is fixed to and electrically connected to the flat plate conductor through welding.

5. The connector production method according to claim 1, wherein after the one or more contacts are pressed into the first insulator in a state of being attached to a contact carrier and the central portions of the one or more contacts are joined to the first insulator, the one or more contacts are detached from the contact carrier.

6. The connector production method according to claim 1, wherein after the shell is placed over the first insulator in a state of being attached to a shell carrier and formation of the second insulator is completed, the shell is detached from the shell carrier.

7. The connector production method according to claim 1, wherein each of the one or more contacts is provided in a portion thereof covered by the second insulator with a contact-side waterproof shaped section for blocking entry of water.

8. The connector production method according to claim 1, wherein the shell is provided in a portion thereof covered by the second insulator with a shell-side waterproof shaped section for blocking entry of water.

9. The connector production method according to claim 1, further comprising providing a waterproof sealing section to a surface of a portion of the second insulator from which the rear end portions of the one or more contacts project.

10. The connector production method according to claim 1, further comprising disposing a seamless waterproof member that surrounds an outer periphery of the second insulator.

11. A connector comprising:

a first insulator;

a flat plate conductor that is held by the first insulator;

one or more contacts whose central portions are joined to the first insulator such that front end portions of the one or more contacts are exposed at a front part of the first insulator and rear end portions of the one or more contacts project from a rear part of the first insulator;

a shell made of metal that is placed over the first insulator so as to cover outer peripheral portions of the one or more contacts and that is fixed to and electrically connected to the flat plate conductor, and a second insulator that is formed so as to close the rear part of the first insulator and a rear part of the shell while the rear end portions of the one or more contacts project from the second insulator.

12. The connector according to claim 11, wherein the flat plate conductor includes ground plates that are pressed into the first insulator so as to be held by the first insulator and exposed on surfaces of the first insulator.

13. The connector according to claim 11, wherein the flat plate conductor includes a mid-plate that is held by the first insulator through formation of the first insulator and that is disposed near front end portions of the one or more contacts.

14. The connector according to claim 11, wherein each of the one or more contacts is provided in a portion thereof covered by the second insulator with a contact-side waterproof shaped section for blocking entry of water.

15. The connector according to claim 11, wherein the shell is provided in a portion thereof covered by the second insulator with a shell-side waterproof shaped section for blocking entry of water.

16. The connector according to claim 11, further comprising a waterproof sealing section provided to a surface of a portion of the second insulator from which the rear end portions of the one or more contacts project.

17. The connector according to claim 11, further comprising a seamless waterproof member that surrounds an outer periphery of the second insulator.

* * * * *